US005334416A

United States Patent [19]

Seong et al.

[11] Patent Number: 5,334,416

[45] Date of Patent: Aug. 2, 1994

[54] HEAT RESISTANT STAINLESS STEEL COATED BY DIFFUSION OF ALUMINUM AND THE COATING METHOD THEREOF

[75] Inventors: Byeong G. Seong; Soon Y. Hwang; Jin H. Song; Kyoo Y. Kim, all of Pohang City, Rep. of Korea

[73] Assignees: Pohang Iron & Steel Co., Ltd.; Research Institute of Industrial Science & Technology, both of Pohang City, Rep. of Korea

[21] Appl. No.: 996,320

[22] Filed: Dec. 23, 1992

[30] Foreign Application Priority Data

Dec. 30, 1991 [KR] Rep. of Korea ..... 91-25135

[51] Int. Cl.[5] ..... C23C 16/06; C23C 16/10; C23C 16/12

[52] U.S. Cl. ..... 427/252; 427/405; 427/419.2; 428/469; 428/699

[58] Field of Search ..... 427/250, 252, 405, 419.2; 428/469, 699

[56] References Cited

U.S. PATENT DOCUMENTS

| | | | |
|---|---|---|---|
| 3,594,219 | 7/1971 | Maxwell et al. | 427/252 |
| 3,595,712 | 7/1971 | Boone et al. | 427/252 |
| 3,625,750 | 12/1971 | Baranow | 427/252 |
| 3,640,815 | 2/1972 | Schwartz et al. | 427/252 |
| 3,692,554 | 9/1972 | Bungardt et al. | 427/252 |
| 3,979,273 | 9/1976 | Panzera et al. | 427/252 |
| 4,004,047 | 1/1977 | Grisik | 427/252 |
| 4,142,023 | 2/1979 | Bornstein et al. | 427/252 |
| 4,467,016 | 8/1984 | Baldi | 427/252 |
| 4,528,215 | 7/1985 | Baldi et al. | 427/252 |
| 4,835,010 | 5/1989 | Krutenat et al. | 427/252 |

OTHER PUBLICATIONS

E. Godlewska and K. Godlewski; Chromaluminizing of Nickel and Its Alloys; 1984; pp. 117–131.

E. Fitzer et al.; Diffusion and Precipitation Phenomena in Aluminized and Chromium-aluminized Iron- and Nickel-base Alloys; pp. 253–269. No date.

*Primary Examiner*—Anthony Green

*Attorney, Agent, or Firm*—Webb Ziesenheim Bruening Logsdon Orkin & Hanson

[57] ABSTRACT

A heat resistant stainless steel coated by diffusion of aluminum and a method of aluminum diffusion coating for heat resistant stainless steels containing nickel and chromium. The stainless steel is buried in a diffusion coating pack powder composed of an aluminum source, an activator and inert filler materials. The coating is heat treated to form a chromium-rich intermediate layer without forming an interdiffusion layer containing aluminide precipitates under an aluminide layer.

16 Claims, 7 Drawing Sheets

HEAT RESISTANT STAINLESS STEEL COATED BY DIFFUSION OF ALUMINUM AND THE COATING METHOD THEREOF

BACKGROUND OF THE INVENTION

1. Field of the Invention

The present invention relates to a heat resistant stainless steel being widely used for high temperature materials in the steel manufacturing industry, the petrochemical industry, etc., and a method for coating by diffusion of aluminum, and more specifically, to a heat resistant stainless steel coated by diffusion of aluminum and the coating method thereof, in which an intermediate layer having the chromium-rich phase under an aluminide layer is formed but an interdiffusion layer is not formed.

2. Description of the Prior Art

Diffusion coating of metal is a method for obtaining the coating layer by diffusing on the surface of materials the component such as chromium, aluminum and silicon independently or more than two kinds thereof at the same time so as to protect from damage of materials against the exterior environment leading to high temperature oxidation, sulfidation, etc., to extend the span of life. Of these, one of the most widely used up to now is the aluminide coating method by diffusion of aluminum. As this method was developed to apply to the parts of aircraft engines mainly, a great deal of study for the alloy of nickel matrix and cobalt matrix was made but the optimum technology for an iron base alloy has not been established as yet.

The process for diffusion coating of aluminum is explained in the following. First, pack powder composed of a source of aluminum, activators, inert filler materials is prepared and mixed well. For a source of aluminum, aluminum powder or aluminum alloy powder is used. For an activator, halide compound enabling to form volatile gas by reacting on aluminum is used. For inert filler materials which play the role of preventing the pack powder from sintering at the high temperature, aluminina powders are used mostly. Then, the material to be coated which is well cleaned, is buried in the pack powder and heated at a non-oxidizing atmosphere. When the high temperature is attained, aluminum is reacted with an activator and thus aluminum halide gas is formed. This gas is resolved when reaching at the surface of the material to be coated, only aluminum remains on the surface of the material to be coated, and aluminum is diffused into the material to be coated, whereby intermetallic compound such as $(Fe, Ni)_2 Al_3$ or (Ni, Fe)Al is formed in succession as well as an interdiffusion layer is formed concurrently at the under part thereof.

A heat resistant stainless steel having an iron as a base metal is widely used in the energy mass-consumptive industry such as petroleum, chemical and steel industries, as its high temperature strength is high, its room temperature processing is easy and it has the advantage of cheapness in comparison with the price of nickel base alloy. Recently, as the method to improve high temperature corrosion resistance of these materials, aluminum diffusion coating attracts public attention.

Using the conventional diffusion coating method for stainless steel, an aluminide layer(2) [$(Fe, Ni)_2 Al_3$ or (Ni, Fe)Al] is formed outside a matrix metal(1) and an interdiffusion layer(3) composed of aluminide precipitates and a ferrite matrix is formed thereunder, as shown in FIG. 1. The interdiffusion layer can be adjusted thicker or thinner than the aluminide layer according to component of pack powder and heat treatment temperature. Meanwhile, aluminide layers are usually brittle and easily fractured when they are excessively thick. The interdiffusion layer can secure ductility as aluminide phase exists in the form of precipitates on the ductile ferrite matrix.

To make use of these properties, the composite coating method forming only an interdiffusion layer by diffusion coating of aluminum with ferrite stabilizing elements such as chromium, niobium and molybdenum is presented in the U.S. Pat. No. 4,835,010.

In this method, chromium is mainly used as the ferrite stabilizing elements. As aluminum diffusion is easily produced in the ferrite phase rather than in the austenite phase, the interdiffusion layer which aluminide is dispersed on the ferrite phase can be easily obtained by adding the ferrite stabilizing elements. In the coating method, aluminum activity is lowered to such an extent that an aluminide layer is not formed, and to coat chromium therewith, Cr-Al alloy powder alloying aluminum of 10–20% is used as a source of aluminum. And when intending to adjust aluminum activity low without adding the ferrite stabilizing elements, Ni-Al alloy powder is used. By using these methods, the coating composed of an interdiffusion layer(3) composed of aluminide precipitates and ferrite matrix can be obtained as shown in FIG. 2.

Meanwhile, the aforesaid composite coating method has the advantage of obtaining ductile coating. In the methods, however, the problem which aluminum required for forming aluminide playing the protection role with regard to high temperature oxidizing atmosphere cannot be supplied for a long time, arises because aluminum concentration of coating layer is low. Also, the methods have a problem which the material costs much, as the alloy powder of expensive elements such as chromium and nickel is used to adjust aliminum activity low when the coating is done. Further, even though cheap Fe-Al alloy can be used, as the aluminum content decreases very much to obtain the sufficiently low aluminum activity from this alloy system, the method has a problem which forming Fe-Al powder by crushing is difficult. Also, it has a problem of high costs as heat treatment should be conducted at temperatures higher than 1,100° C. to suppress the formation of the aluminide layer and to deepen a diffusion depth of aluminum.

The life span of an aluminide coating is changed according to the content of aluminum and the length of time that aluminum remains in the coating. There are two processes in reducing the concentration of alunium. One is that an alumina protection film formed at high temperatures falls apart from the surface by thermal shock. The other is that aluminum of the coating exposed in the high temperature is diffused into a matrix. Consequently, extension of life span of the material and the coating is possible if the aforesaid two processes can be suppressed. To prevent aluminum depletion due to spalling of alumina, adhesion of alumina should be increased. For increasing adhesion of the protection film, there is a method of adding rare earth elements in the coating. To prevent aluminum diffusion into the matrix, a layer enabling to prevent from diffusing can be thought. Fitzer, Maurer, et al. proposed the technology of extending the life span of the coating by forming diffusion barrier composed of the main component of alloy element having low solubility with regard to aluminide when diffusion coating on a nickel base alloy is done (E. Fitzer and J. J. Maurer: Materials and Coatings to Resist High Temperature Corrosion, Applied Science, London, 1978, P253). Their studies revealed that a diffusion barrier they proposed has Cr and Ni as main components and effects of obstructing aluminum from diffusing inside are apparent. And Godlewska et al. reveal that Cr-rich precipitates which exist under the coating when aluminum diffusion coating of nickel matrix superalloy is done, obstruct aluminum from diffusing inside and thus are of help to resistivity of coating for oxidation in view of a long term (E. Godlewska and K. Godlewski, Oxidation of Metals, Vol. 22, Nos. ¾, 1984, P117).

The present inventor made researches and conducted experiments to solve the aforesaid problems and proposed the present invention based upon the results thereof. The object of the present invention is to provide for a heat resistant stainless steel coated by aluminum diffusion and the aluminum diffusion coating method for a heat resistant stainless steel in which heat resistance and corrosion resistance are improved by burying a heat resistant stainless steel containing a large content of Ni and Cr in the appropriate diffusion coating pack powder, by coating with heat treatment, and by forming, under the aluminide layer, Cr-rich intermediate layer.

SUMMARY OF THE INVENTION

Hereinafter, the present invention is explained.

The present invention provides for a method of aluminum diffusion coating for a heat resistant stainless steel containing mainly nickel and chromium as the alloy component, and a heat resistant stainless steel coated by aluminum diffusion according to such method, in which the heat resistant stainless steel is buried in the diffusion coating pack powder composed of a source of aluminum, activators and inert filler materials, and diffusion heat treatment (coating treatment) thereof is conducted, so that chromium-rich intermediate layer is formed under the aluminide layer but an interdiffusion layer is not formed thereunder.

The present invention is explained in more detail in the following.

For the aforesaid source of aluminum, aluminum powders or aluminum alloy powders can be used. For the aforesaid aluminum alloy powders, alloy powders such as Fe-Al, Cr-Al and Ni-Al can be used. If aluminum contents of the alloy powder are low and thus activity of aluminum becomes excessively low, however, an aluminide layer is not formed or such layer is formed too thin. As a result, it is desirable that aluminum contents in each alloy should be more than 30 weight percentage (wt %). Contents of pack powder are adjusted to contain more than 2 wt % if aluminum powder is used for a source of aluminum, and more than 5 wt % if aluminum alloy powder is used. If contents of source for aluminum supply become less than the aforesaid wt %, supply of aluminum is not so uniform that thickness of coating layer becomes irregular. Considering also sintering prevention of metal powders, it is desirable that contents of the source for aluminum supply should be less than 50 wt %.

The aforesaid activator plays the role of conveying aluminum by reacting on the aluminum source for aluminum supply, forming aluminum halide gas, and diffusing onto the surface of test pieces. For an activator, various halogen compound such as $NH_4Cl$, NaF, $NH_4F$, NaCl, etc., can be used. It is desirable that addition volume should be established as more than 1.0 wt % to maintain homogeneity when powder is mixed. In the case where $NH_4Cl$, $NH_4F$ and high volatile activator are added too much, retort (a vessel in which pack powder and coating test piece is put) can be deformed due to excessive internal pressure, or has the fear of explosion in the severe case. As the result, it is desirable that total volume of activator should be less than 5 wt %.

The aforesaid inert filler materials support the object of coating, provides for path through which gases joined in coating reaction can move, and plays the role of preventing metal powder from sintering each other. As an example, alumina($Al_2O_3$) is mostly used. Addition of aluminum nitride(AlN) which plays the acceleration role in order that retort interior produces a reducing atmosphere by reacting on moisture or oxygen contained in pack powder.

It is desirable that the aforesaid diffusion heat treatment temperature should be established as 850°–1,025° C. because it takes a long time to obtain the proper coating thickness due to too low temperature if heat treatment temperature is lower than 850° C., and an interdiffusion layer is formed without forming an intermediate layer due to instability of the phase forming an intermediate layer if such temperature is higher than 1,025° C.

Also, the time required for diffusion heat treatment varies in accordance with coating temperature, and it is desirable that such time should be established as 5–20 hours because that attaining the coating effects is difficult due to too thin coating layer when the time is established as less than 5 hours and that it is uneconomical as an intermediate layer obstructs aluminum(Al) from diffusing and thus coating layer does not become thicker any more when the time is established as more than 20 hours.

The more desirable conditions for temperature and time required for diffusion heat treatment are that time for heat treatment should be 10–20 hours when heat treatment temperature is 850°–950° C. and that such time should be 5–15 hours when heat treatment temperature is 950°–1,025° C.

The heat resistant stainless steel which is more desirably applicable to the present invention should contain Ni of more than 20 wt % and Cr of more than 25 wt %.

Aluminum diffusion coating is conducted by burying material to be treated in a coating pack box containing diffusion coating pack powder constructed as mentioned above, by a dispersing inert or reducing atmosphere gas, and by concurrently heating. During the coating process, a source of aluminum reacts on an activator at high temperatures and thus an aluminum halide gas compound is formed. And, while this gas is dissociated from aluminum and halide gas on the surface of coated material to be treated, aluminum on such surface is diffused inside and thus an aluminide layer is formed.

If coating is done according to the present invention as mentioned above, an aluminide layer(2) is formed outside a heat resistant stainless steel i.e. a matrix metal(1), and an intermediate layer(4) containing chromium of more than 40% is concurrently formed between the matrix metal(1) and the aluminide layer(2) which chromium having low solubility in aluminide phase is rejected during the coating process, but on the other hand, an interdiffusion layer(3) having aluminide precipitates and ferrite matrix is not formed.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF PREFERRED EMBODIMENT

Hereinafter, the present invention will be explained through the Examples in more detail.

EXAMPLE 1

After diffusion coating with diffusion coating pack powder and under heat treatment condition as described in the following Table 1 using, as a matrix metal, 10×10×5 mm sized heat resistant stainless steel comprising C of 0.38 wt %, Si of 1.01 wt %, Mn of 1.00 wt %, Cr of 30.01 wt %, Ni of 30.01 wt %, W of 1.15 wt %, residual Fe and other inevitably containing impurities, investigation was conducted as to whether intermediate layers and interdiffusion layers are formed and as to oxidation resisting property, by observing coating microstructures for each test piece. The results thereof are indicated in the following Table 1. Also, the intermediate layer formed from the invention product (7) in the following Table 1 is observed using electron microscope and the photograph taken as the result of the observation was indicated in FIG. 4.

Meanwhile, cyclic corrosion tests were conducted with the uncoated test pieces, and oxidation resisting properties in the following Table 1 were indicated as "good" when the beginning time weight rapidly reduces is more than 700 hours and "bad" when such beginning time is less than 700 hours.

Figure 5:
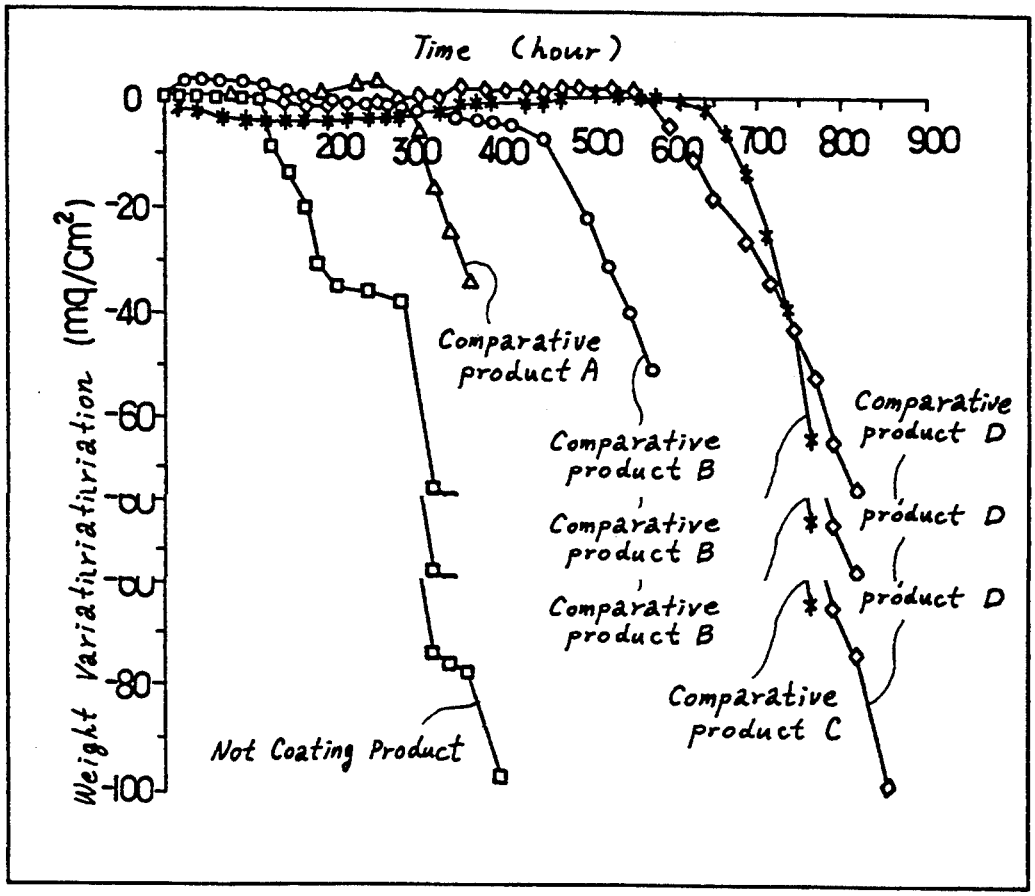
FIG. 5 and FIG. 6 are graphs showing the results of cyclic corrosion tests conducted under oxidizing atmosphere to evaluate oxidation resisting properties of coatings after diffusion coating treatments of heat resistant stainless steels are conducted.
Figure 6:
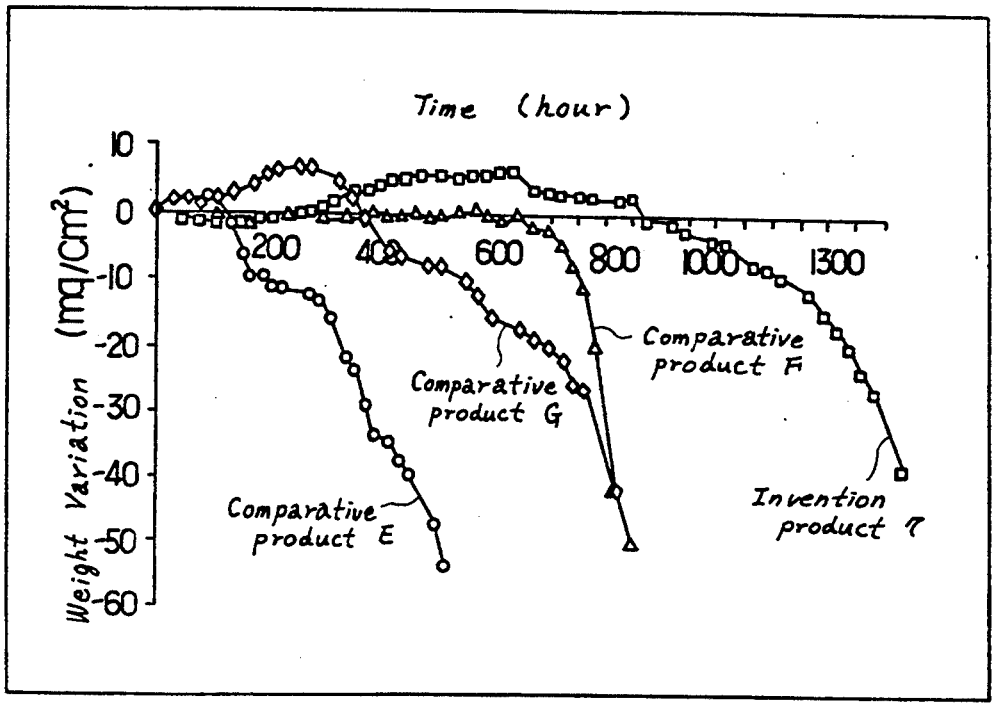

The aforesaid cyclic corrosion test was conducted under mixed gas atmosphere comprising $N_2$ of 75 Vol. %, $H_2O$ of 12 Vol. %, $O_2$ of 3.5 Vol. %, $CO_2$ of 9.5 Vol. % and $SO_2$ of 200 ppm. And to promptly evaluate high temperature resisting oxidization of coating layer, each cycling was made for 1 hour by maintaining at the high temperature of 1,100° C. for 45 minutes and then by cooling at room temperature for 15 minutes. Weight variation was measured once every 20 or 40 cycle. As for the invention product (7) and comparative products (A–G) of test pieces in the following Table 1, weight variation was indicated as per unit area for time, as shown in FIGS. 5 and 6.

Figure 1:
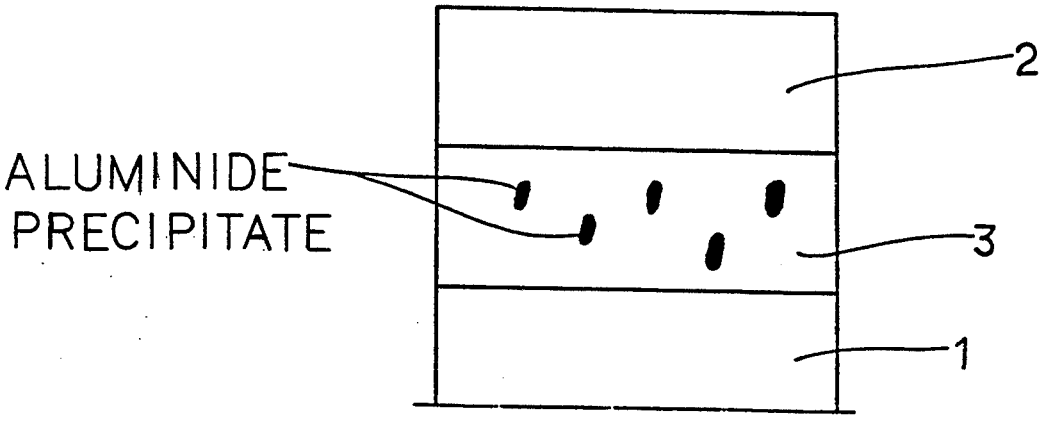
FIG. 1 and FIG. 2 are cross sectional schematic views illustrating aluminum diffusion coating layer of a heat resistant stainless steel, formed according to the conventional coating method.
Figure 2:
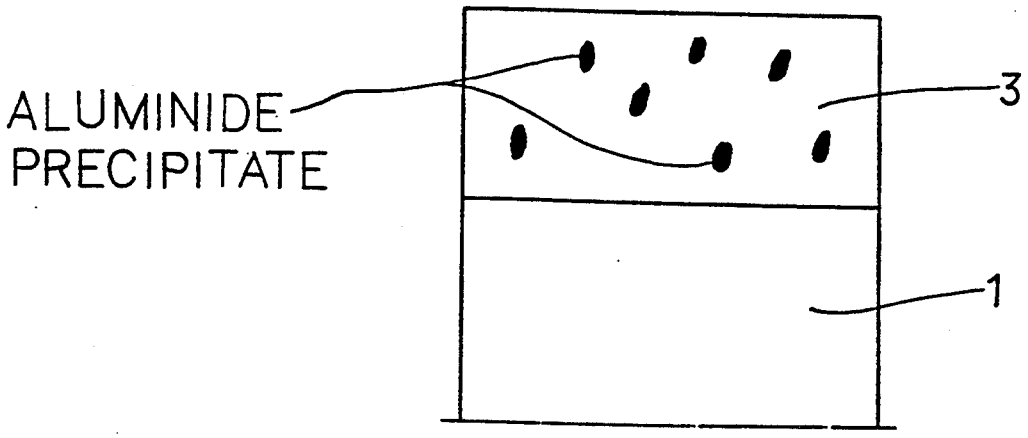
Figure 3:
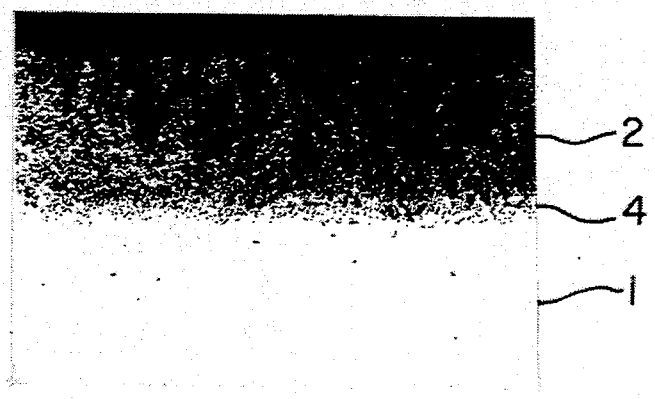
FIG. 3 is a photograph showing sectional microstructure of aluminum diffusion coating layer of a heat resistant stainless steel, formed according to the present invention.
Figure 4A:
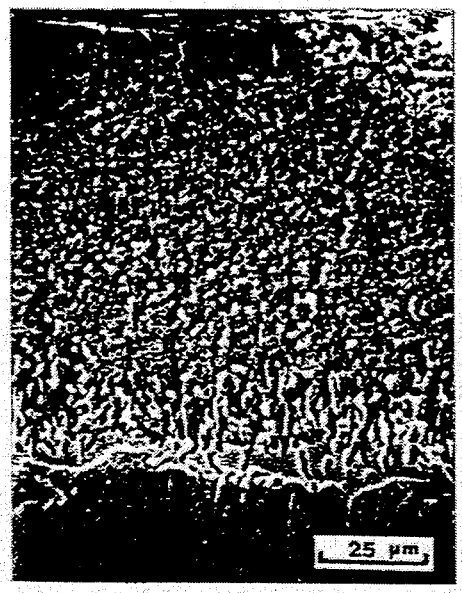
FIGS. 4(*a*)–4(*d*) are photographs each of electron microscope showing distribution of each component element in aluminum diffusion coating layer of a heat resistant stainless steel, formed according to the present invention.
Figure 4B:
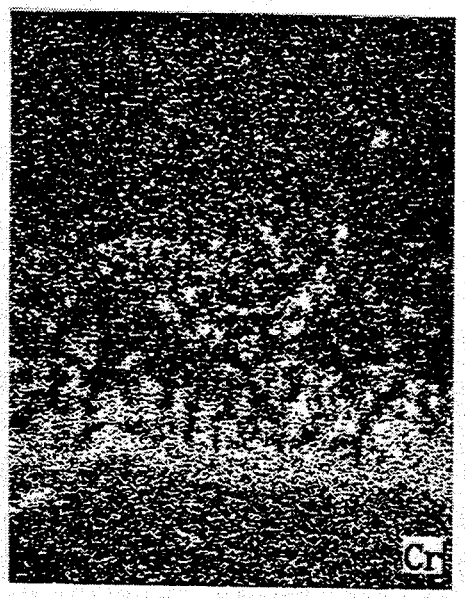
Figure 4C:
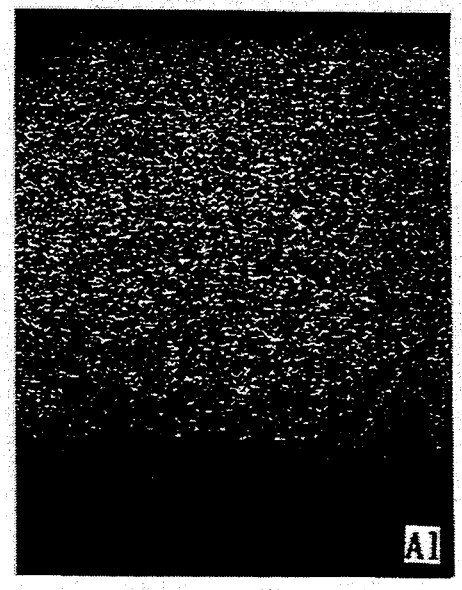
Figure 4D:
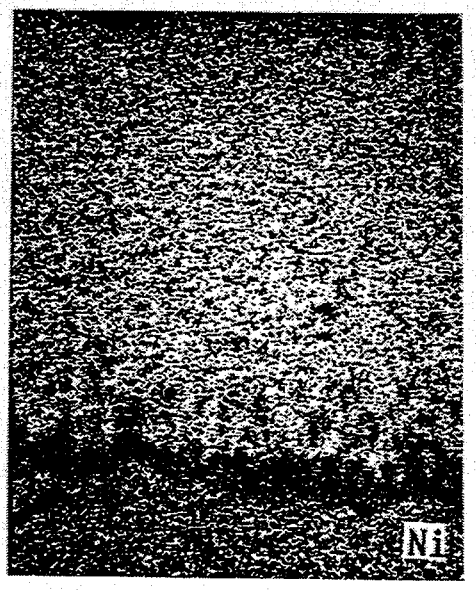

And, comparative products (A) and (B) described in the following Table 1 were coated under the coating condition similar to that presented in the U.S. Pat. No. 4,835,010, and comparative products (C–G) were coated under the coating condition of the conventional method having the microstructure as indicated in the FIG. 1.

TABLE 1

| Test piece No. | Diffusion Coating Pack Powder Component ratio: Al Supply Source | Activator | Inert filler materials | Heat treatment condition: temperature (°C.) | time (hr) | Formation of intermediate layer (Yes, No) | Formation of interdiffusion layer (Yes, No) | Oxidation Resisting Property |
|---|---|---|---|---|---|---|---|---|
| Invention Product | | | | | | | | |
| 1 | 5% Al | 2% NaCl, 1% $NH_4Cl$ | residue: $Al_2O_3$ | 1000 | 15 | Yes | No | Good |
| 2 | 5% (Fe-50Al) | " | " | " | " | " | " | " |
| 3 | 10% (Fe-50Al) | 2% NaCl | " | " | " | " | " | " |
| 4 | 30% (Fe-50Al) | " | " | " | " | " | " | " |
| 5 | 20% (Fe-50Al) | 2% NaCl, 1% $NH_4Cl$ | " | 900 | 15 | " | " | " |
| 6 | " | " | " | 950 | " | " | " | " |
| 7 | " | " | " | 1000 | " | " | " | " |
| 8 | " | " | " | 1025 | " | " | " | " |
| 9 | " | 3% NaF | " | 1000 | " | " | " | " |
| 10 | " | 3% $NH_4Cl$ | " | " | " | " | " | " |
| 11 | " | 3% $NH_4F$ | " | " | " | " | " | " |
| Comparative Product | | | | | | | | |
| A | 25% (70Cr-30Al) | 2% NaCl, 1% $NH_4Cl$ | residue: $Al_2O_3$ | 1100 | 10 | No | Yes | Bad |
| B | 19% NiAl | 3% $NH_4Cl$ | " | " | " | " | " | " |
| C | 16% (62Ni-30Al) | " | " | " | " | " | " | " |
| D | 20% (Fe-30Al) | 2% NaCl, 1% $NH_4Cl$ | " | 1100 | 6 | " | " | " |
| E | 5% Al | 3% $NH_4Cl$ | " | " | " | " | " | " |
| F | 12% (Fe-50Al) | " | " | " | " | " | " | " |
| G | 13% (Fe-47Al) | " | " | 1050 | 10 | " | " | " |
| H | 20% (Fe-50Al) | 2% NaCl, 1% $NH_4Cl$ | " | 800 | 15 | Yes | No | " |

As indicated in the above Table 1, it can be seen that in case of the invention products (1–11) coated according to the present invention, Cr-rich intermediate layer is formed and an interdiffusion layer is not formed, and that in case of comparative products (A–G) coated under the condition which deviated from the scope of the present invention, an interdiffusion layer is formed but on the other hand, an intermediate layer is not formed.

In order to observe in more detail the intermediate layer generated in the present invention products, the intermediate layer formed from the invention product (7) of the above Table 1 was observed using electron microscope and the photograph taken as the result of the observation was indicated in FIG. 4.

(A) of FIG. 4 indicates a general electron microscope photograph of coating layer and (B), (C), and (D) of FIG. 4 are the photographs in which Cr component, Al component and Ni component only were put in appearance respectively at the same position of (A) of FIG. 4. White part in FIG. 4 indicates each component, and it is indicated that such component contains more contents thereof as long as whiteness concentration therein becomes thicker.

As indicated in FIG. 4, it can be seen that an intermediate layer excludes aluminum and nickel and contains a large content of chromium component. And it was verified that chromium detected from the internal aluminide layer was chromium carbide.

After removing aluminide layer to analyze the accurate phase of an intermediate layer, diffraction analysis of X-rays was done. As the result, it was verified that the intermediate phase was sigma FeCr intermetallic compound.

Further, it can be seen that oxidation resisting properties in cases of the invention products (1–11) are good, but on the other hand, oxidation resisting properties in cases of the comparative products (A–G) are bad. These facts can be verified by FIGS. 5 and 6.

Namely, it can be seen that as indicated in FIGS. 5 and 6, the present invention product (7) reveals the superior oxidation resisting property of more than 1,000 hours, but on the other hand, the comparative products (A–G) reveal the inferior oxidation resisting properties of approximate 450–700 hours.

Even though it is not indicated in FIGS. 5 and 6, it was verified that the invention products (1, 2, 3, 4, 8, 9, 10, 11) had the similar coating thickness (100–120 μm) to the invention product (7) and revealed oxidation resisting properties of approximate 1,000 hours, and the invention products (5, 6) had the thinner thicknesses of 50 μm and 60 μm respectively due to somewhat low coating temperature, but on the other hand, revealed oxidation resisting properties of 750 hours and 850 hours respectively, which are superior to those of the comparative products.

Meanwhile, the comparative product (H) reveals the bad oxidation resisting property in spite of formation of an intermediate layer. This is because that coating temperature is too low and thus the thickness of the coating layer becomes too thin.

EXAMPLE 2

Figure 7:
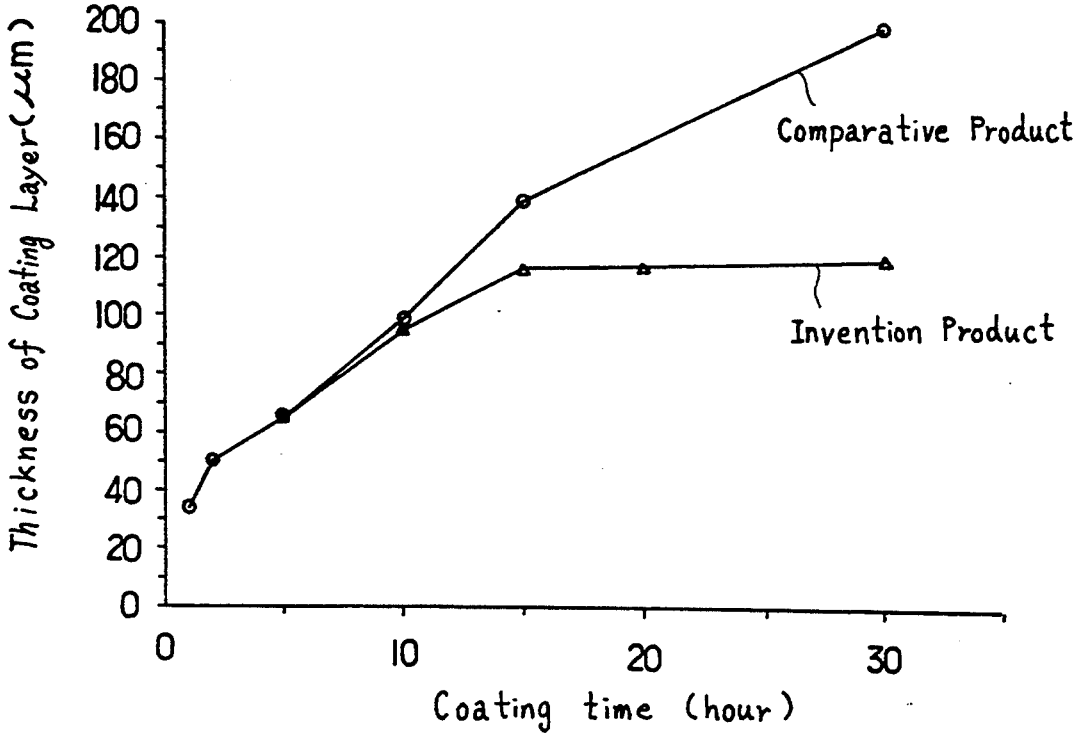
FIG. 7 is a graph showing the comparison results of thickness variation of diffusion coating layer to coating time of a heat resistant stainless steel, formed according to the present invention and the conventional method.

After diffusion coating for the coating time (the time required for diffusion heat treatment) indicated in FIG. 7 using diffusion pack powder comprising the same as the invention product (5) of test pieces indicated in the Table 1 of the aforesaid Example 1, thickness of coating layer as a function of the coating time was investigated. The results of the investigation were indicated in FIG. 7.

In FIG. 7, heat treatment temperature in case of the comparative products was 1,050° C. which deviates from the scope of the present invention, but the heat treatment temperature in case of the invention products was 1,000° C.

As shown in FIG. 7, in case of the comparative product, thickness of coating continuously increases as long as coating time increases. And in case of invention products, it is almost certain that thickness does not increase significantly after 10 hours, and any occasion of causing a problem by brittleness of coating layer in such a case that thickness of coating layer becomes excessively thick, did not arise in spite of long coating time.

Consequently, it is desirable that diffusion heat treatment time should be 10–20 hours when heat treatment temperature is 850°–950° C. and that such time should be 5–15 hours when the temperature is 950°–1,025° C.

As explained in the foregoing, the present invention has the effects of providing for aluminum diffusion coating layer of a heat resistant stainless steel having the coating layer of high temperature resisting oxidization which is quite superior to the coating layer according to the conventional method, and the coating method thereof, wherein the costly alloying elements such as chromium, nickel, niobium and molybdenum are not necessarily required for strictly adjusting activity of aluminum or for adding ferrite stabilizing elements as well as expenses for coating are saved due to lower heat treatment temperature than the existing condition, and without forming interdiffusion layer containing aluminide precipitates under the aluminide layer, only chromium-rich intermediate layer is formed.

What is claimed is:

1. A method of aluminum diffusion coating a heat resistant stainless steel containing nickel and chromium as main alloy components, wherein the method comprises the steps of:

a) burying said heat resistant stainless steel in a diffusion coating pack powder composed of an aluminum source, an activator and inert filler materials, b) treating the steel and powder at 850°–1025° C. for 5–20 hours, and c) forming an outer aluminide layer and a chromium-rich intermediate layer on the stainless steel, without forming an interdiffusion layer containing aluminide precipitates, under the aluminide layer.

2. A method of aluminum diffusion coating for a heat resistant stainless steel as set forth in claim 1, wherein said diffusion coating pack powder includes aluminum powder of 2–50 wt %, an activator composed of a halogen compound of 1–5 wt % and the balance inert filler materials.

3. A method of aluminum diffusion coating for a heat resistant stainless steel as set forth in claim 1, wherein said diffusion coating pack powder includes an aluminum alloy powder of 5–50 wt %, an activator composed of a halogen compound of 1–5 wt % and residual inert filler materials.

4. A method of aluminum diffusion coating for a heat resistant stainless steel as set forth in claim 1, wherein said intermediate layer is a sigma FeCr intermetallic compound.

5. A method of aluminum diffusion coating for a heat resistant stainless steel as set forth in claim 3, wherein said aluminum alloy powder is Fe-Al alloy powder.

6. A method of aluminum diffusion coating for a heat resistant stainless steel as set forth in claim 1, wherein said activator is selected from a group consisting of $NH_4Cl$, NaF, $NH_4F$ and NaCl.

7. A method of aluminum diffusion coating for a heat resistant stainless steel as set forth in claim 1, wherein said inert filler materials are aluminum oxide ($Al_2O_3$) or aluminum nitride (AlN).

8. A method of aluminum diffusion coating for a heat resistant stainless steel as set forth in claim 6, wherein said inert filler materials are aluminum oxide ($Al_2O_3$) or aluminum nitride (AlN).

9. A method of aluminum diffusion coating for a heat resistant stainless steel as set forth in claim 1, wherein said heat resistant stainless steel includes at least 20% by weight Ni and at least 25% by weight Cr.

10. A method of aluminum diffusion coating for a heat resistant stainless steel as set forth in claim 6, wherein said heat resistant stainless steel includes at least 20% by weight Ni and at least 25% by weight Cr.

11. A method of aluminum diffusion coating for a heat resistant stainless steel as set forth in claim 7, wherein said heat resistant stainless steel includes at least 20% by weight Ni and at least 25% by weight Cr.

12. A method of aluminum diffusion coating for a heat resistant stainless steel as set forth in claim 8, wherein said heat resistant stainless steel includes at least 20% by weight Ni and at least 25% by weight Cr.

13. A heat resistant stainless steel coated by aluminum diffusion, wherein the coated heat resistant stainless steel comprises a chromium-rich intermediate layer formed on the stainless steel and an outer aluminide layer formed on said intermediate layer.

14. A heat resistant stainless steel coated by aluminum diffusion as set forth in claim 13, wherein said intermediate layer has a chromium content of more than 40 wt. %.

15. A heat resistant stainless steel coated by aluminum diffusion as set forth in claim 13, wherein said intermediate layer is a sigma FeCr intermetallic compound.

16. A heat resistant stainless steel coated by aluminum diffusion as set forth in claim 14, wherein said intermediate layer is a sigma FeCr intermetallic compound.

* * * * *

UNITED STATES PATENT AND TRADEMARK OFFICE

CERTIFICATE OF CORRECTION

PATENT NO. : 5,334,416

DATED : August 2, 1994

INVENTOR(S) : Byeong G. Seong, Soon Y. Hwang, Jin H. Song and Kyoo Y. Kim

It is certified that error appears in the above-indentified patent and that said Letters Patent is hereby corrected as shown below:

Column 1 Line 41 "aluminina" should read --alumina--.

Column 2 Line 39 "aliminum" should read --aluminum--.

Column 2 Line 53 "alunium" should read --aluminum--.

Column 4 Lines 2-3 "addition" should read --additional--.

Column 7 Line 50 "approximate" should read --approximately--.

Signed and Sealed this

Eleventh Day of October, 1994

*Attest:*

*Attesting Officer*

BRUCE LEHMAN

*Commissioner of Patents and Trademarks*